US007258096B2

(12) United States Patent
Mori et al.

(10) Patent No.: US 7,258,096 B2
(45) Date of Patent: Aug. 21, 2007

(54) OIL FILTER FIXING SYSTEM FOR V TYPE ENGINE

(75) Inventors: Seiichi Mori, Sagamihara (JP); Manabu Enari, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/359,454

(22) Filed: Feb. 23, 2006

(65) Prior Publication Data

US 2006/0231060 A1 Oct. 19, 2006

(30) Foreign Application Priority Data

Apr. 18, 2005 (JP) ..... 2005-120221

(51) Int. Cl.
*F01M 11/03* (2006.01)
*F02B 75/22* (2006.01)

(52) U.S. Cl. ..... 123/196 A; 123/196 R; 123/54.4; 210/416.5; 210/167.02; 184/6.5

(58) Field of Classification Search ..... 123/196 R, 123/196 A, 196 S, 54.4–54.8; 210/416.5, 210/167.02, 172.1, 172.2, 172.3, 172.4; 184/6.5
See application file for complete search history.

(56) References Cited

U.S. PATENT DOCUMENTS 5,032,259 A * 7/1991 He et al. ..... 210/133
5,472,045 A * 12/1995 Poehlman ..... 165/119
5,566,781 A * 10/1996 Robert et al. ..... 184/1.5
5,647,315 A * 7/1997 Saito ..... 123/196 AB
5,771,854 A * 6/1998 Barton ..... 123/196 R
5,860,402 A * 1/1999 Sakurai et al. ..... 123/196 R
6,016,784 A * 1/2000 Tanaka ..... 123/196 R
6,478,005 B2 * 11/2002 Tsubouchi ..... 123/195 P
6,513,478 B2 * 2/2003 Tsubouchi ..... 123/195 A
6,530,356 B2 * 3/2003 Inoue et al. ..... 123/196 R
6,652,664 B2 * 11/2003 Durocher et al. ..... 134/26
7,162,985 B2 * 1/2007 Itoh et al. ..... 123/90.31

FOREIGN PATENT DOCUMENTS

JP 11-241612 9/1999
RU 2194169 C2 * 12/1997

* cited by examiner

*Primary Examiner*—Noah P. Kamen
*Assistant Examiner*—Ka Chun Leung
(74) *Attorney, Agent, or Firm*—Wenderoth, Lind & Ponack, L.L.P.

(57) ABSTRACT

The number of constituent parts for an oil filter fixing system such as a bracket, are reduced, and the oil leaks during filter element exchange are avoided. The oil filter fixing system comprises a V bank of a V type engine, a crankcase fixed with the V bank and an oil filter fixed with the crankcase. A horizontal fixing plane is formed at a part of an outer surface of the crankcase and the oil filter is directly fixed with and hung down from the horizontal plane. Further, the horizontal fixing plane is provided at an outer surface of the crankcase and moreover under a cam fixing portion provided in the crankcase. The oil filter is disposed in a space which is formed by the horizontal fixing plane and a lower vertical side surface of the crankcase.

4 Claims, 2 Drawing Sheets

OIL FILTER FIXING SYSTEM FOR V TYPE ENGINE

BACKGROUND OF THE INVENTION (1) Field of the Invention

The present invention relates to an oil filter fixing system for a V type engine which has oil filters fixed with a crankcase.

(2) Description of the Prior Art

FIG. 2 is a cross sectional view of cylinders and oil filters of a conventional V type diesel engine.

The conventional V type diesel engine comprises a crankcase 1, right and left V-banks 30, a crank axis 3, and a cylinder or cylinder liner 4 with a center 4*a*. A cam axis fixing portion 5 provided for each V bank supports the cam axis by a bearing.

A main bearing 7 supports the crank having the crank axis 3.

An oil filter 10 is fixed, by a bracket 20, with a side portion of the crankcase 1.

A bracket fixing surface 21 parallel to the center of the cylinder 4 is fixed with the bracket 20 by a plurality of bolts 22. There is formed a filter fixing horizontal surface 02 inclined at an angle $\alpha$ from the bracket fixing surface 21. The oil filter 10 is fixed to and hung down from the filter fixing surface 02.

Further, JP11-241612A (1999) discloses an oil filter 10 fixed directly with an almost vertical filter fixing surface on a first oil pan fixed with a lower portion of the crankcase of a slanted engine.

In FIG. 2, the bracket 20 is fixed with the bracket fixing surface on the side portion of the crankcase, thereby forming the vertical filter fixing surface. The oil filter 10 is fixed to and hung down from the vertical filter fixing surface, which prevents oil leaks from the gap formed between the filter fixing surface of the crankcase side and the fixing surface of the oil filter during the filter element exchange. However, extra parts such as the casting product of the bracket 20 are needed for fixing the oil filter hung vertically from the crank.

Further, the apparatus is large-sized and heavy, because the brackets 20 and the oil filters 10 are projected to the right and left sides.

On the other hand, JP 11-241612A (1999) teaches to fix an oil filter directly with a filter fixing surface formed on the first oil pan of the crankcase, which eliminates a bracket for fixing the oil filter. However, the disadvantage is that oil leaks from the gap formed between the filter fixing surface of the crankcase side and the fixing surface of the oil filter during filter element exchanges as the filter fixing surface is formed to be almost vertical.

SUMMARY OF THE INVENTION

An object of the present invention is to reduce the number of oil filter fixing members such as a bracket, thereby making the apparatus light-weighted and small-sized. Another object of the present invention is to avoid an oil leak during the oil element exchange, thereby avoiding the apparatus contamination.

First, the oil filter fixing system of the present invention comprises a V bank of the V type engine, a crankcase fixed with the V bank and an oil filter fixed, by a plurality of bolts, with the crankcase. A horizontal fixing plane is formed at a part of an outer surface of the crankcase and the oil filter is directly fixed with and hung down from the horizontal plane.

Second, in the oil filter fixing system, the horizontal fixing plane is provided at an outer surface of the crankcase and the oil filter is directly fixed with and hung down from the horizontal fixing plane. This structure prevents an oil leak from the gap between the oil filter fixing plane of the crankcase side and the fixing plane of the oil filter when bolts for fixing the oil filter are loosened for filter element exchange, thereby avoiding apparatus contamination. The oil filter is directly fixed with the fixing plane of the crankcase, avoiding filter fixing members such as a bracket.

Third, the horizontal fixing plane is provided at an outer surface of the crank case and moreover under a cam fixing portion provided for each V bank. The oil filter is disposed in a space which is formed by the horizontal fixing plane and a lower vertical side surface of the crankcase, and a pair of the oil filters is disposed symmetrically about a crank axis.

With this, oil filters are fixed with and hung from the filter fixing plane by utilizing a pair of spaces, each of which is formed by the horizontal fixing plane and the lower vertical side surface of the crankcase, and the oil filter is disposed within the maximum width of the crankcase.

According to the present invention, first, the constituent parts are reduced, because an oil filter fixing member such as the bracket is not necessary. Further, the apparatus is not contaminated, because the oil filter is vertically hung down, thereby avoiding an oil leak during the filter element exchange.

According to the present invention, second, a light-weight and compact oil filter fixing system is provided, because the oil filter is disposed within the maximum width of the crankcase.

DETAILED DESCRIPTION OF THE PREFERRED EMBODIMENTS

Figure 1:
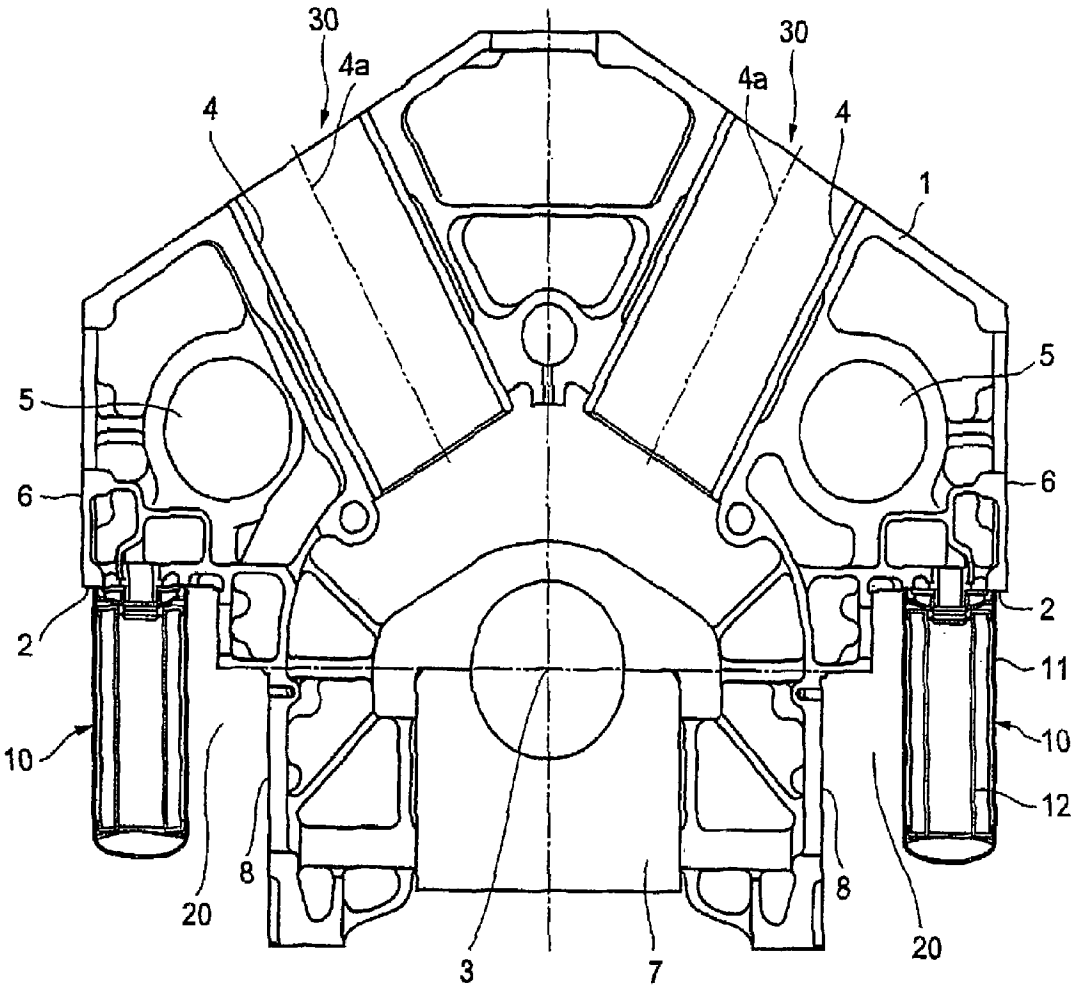
FIG. 1 is a cross sectional view of an oil filter of the present invention of the V type engine.

The present invention is explained referring to the drawings. It should be understood that the present invention is not limited to specifically described sizes, materials and relative arrangements and so on regarding the constituent components.

FIG. 1 is a cross sectional view of an oil filter arrangement of the present invention for a V type engine.

A V type diesel engine comprises a crankcase 1, right and left V-banks 30, a crank axis 3, and cylinders 4 with centers 4*a*. A cam axis fixing portion 5 supports the cam axis by bearings of the cam fixing portions being provided in the V bank 30.

A main bearing 7 supports the crank having the crank axis 3.

Right and left filter fixing planes 2 are formed at positions symmetrical about the crank axis 3 and at horizontal smooth surfaces of the lower portions of the cam axis fixing portion 5.

Oil filters 10 are directly fixed to and hung down from the filter fixing surfaces 2.

Accordingly, oil filters 10 are provided in a space 20 formed by the filter fixing surfaces 2 and a lower side portion 8 of the crankcase 1 at the side of the main bearing 7, and a pair of the oil filters is disposed symmetrically about the crank axis 3.

When the oil filter is removed from the crankcase 1, in order to exchange and clean the oil filter 10, after driving the engine, the oil filled in the vertically hung oil filter does not leak. Accordingly, the engine is not contaminated by the oil.

Figure 2:
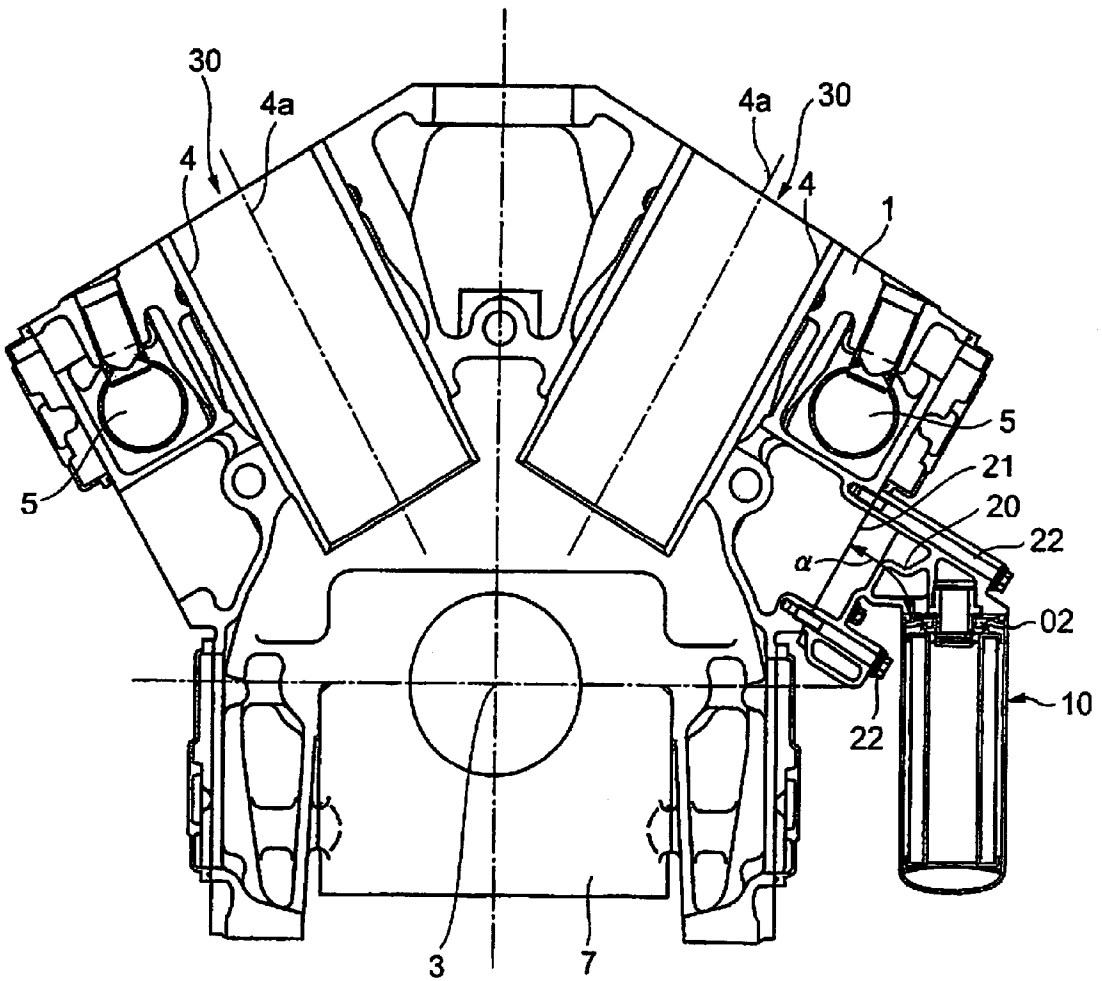
FIG. 2 PRIOR ART
FIG. 2 is a cross sectional view of a conventional oil filter of the V type engine.

Further, an oil filter fixing member such as the bracket 20 as shown in FIG. 2 is not necessary, because the oil filter is directly fixed with the filter fixing surface 2, thereby reducing the number of constituent members for fixing the oil filter.

Further, the oil filter 10 is provided within the maximum width of the crankcase 1, thereby providing a light-weight and compact structure for fixing the oil filter 10.

What is claimed is:

1. An oil filter fixing system, comprising:

a V bank of a V type engine;

a crankcase fixed with said V bank;

an oil filter fixed with said crankcase, wherein:

a horizontal fixing surface is formed at a part of an outer surface of said crankcase;

said oil filter is directly fixed with and hung down from said horizontal surface; and wherein:

said horizontal fixing surface is provided a cam fixing portion provided in said crankcase; and said oil filter is disposed in a space formed by said horizontal fixing surface and a lower vertical side surface of said crankcase.

2. The oil filter fixing system of claim 1, wherein a pair of said oil filters is disposed symmetrically about a crank axis.

3. An oil filter fixing system, comprising:

a V bank of a V type engine;

a crankcase fixed with said V bank; and a horizontal fixing surface for fixing an oil filter, said horizontal fixing surface formed at a part of an outer surface of said crankcase and configured to directly fix and hang down an oil filter therefrom;

wherein said horizontal fixing surface has a cam fixing portion provided in said crankcase and is arranged such that the oil filter is disposed in a space formed by said horizontal fixing plane and a lower vertical side surface of said crankcase.

4. The oil filter fixing system of claim 3, wherein a pair of said horizontal fixing surfaces are disposed symmetrically about a crank axis of said crankcase.

* * * * *